US005080566A

United States Patent [19]

Sakata et al.

[11] Patent Number: 5,080,566

[45] Date of Patent: Jan. 14, 1992

[54] FLUID SCROLL MACHINE WITH PROJECTION ON ONE SIDE OF OLDHAM RING

[75] Inventors: Hirotsugu Sakata, Chigasaki; Toshinobu Inoue, Numazu; Satoru Oikawa, Fuji, all of Japan

[73] Assignee: Kabushiki Kaisha Toshiba, Kawasaki, Japan

[21] Appl. No.: 486,234

[22] Filed: Feb. 28, 1990

[30] Foreign Application Priority Data

Feb. 28, 1989 [JP] Japan ..... 1-47267

[51] Int. Cl.[5] ..... F01C 1/04; F16D 3/04

[52] U.S. Cl. ..... 418/55.3; 418/188; 464/105

[58] Field of Search ..... 418/55.3, 188; 464/102, 464/104, 105

[56] References Cited

U.S. PATENT DOCUMENTS 4,927,339 5/1990 Riffe et al. ..... 418/188

FOREIGN PATENT DOCUMENTS 55-177086 12/1980 Japan .

63-88288 4/1988 Japan ..... 418/55.3

*Primary Examiner*—John J. Vrablik

*Attorney, Agent, or Firm*—Cushman, Darby & Cushman

[57] ABSTRACT

A fluid scroll machine comprises a fluid mechanism including first and second spiral blades located in a frame to eccentrically rotate and a compression chamber defined by the spiral blades, and an Oldham's coupling movably supported by the frame and including a ring-shaped plate having one side facing the first spiral blade and an axis center, a pair of first projections projected from the one side of the ring-shaped plate, and a pair of second projections projected from the one side of the ring-shaped plate. The first spiral blade includes a pair of first guide passages extended in a same direction as a first radial direction of the ring-shaped plate and into which the first projections are fitted to slide in a first radial direction of the plate. The second spiral blade includes a pair of second guide passages extended in a same direction as a second radial direction of the ring-shaped plate and into which the second projections are fitted to slide in the second radial direction of the plate.

6 Claims, 15 Drawing Sheets

FLUID SCROLL MACHINE WITH PROJECTION ON ONE SIDE OF OLDHAM RING

BACKGROUND OF THE INVENTION

1. Field of the Invention

The present invention relates to a fluid scroll machine provided with mechanics having a combination of two spiral vanes or blades for fluid.

2. Description of the Related Art

In the case of one of the conventional scroll compressors (or fluid scroll machines), the compressing section comprising a pair of fixed and whirling blades is housed in a closed case. As shown in FIG. 1, fixed blade 3 is formed by projecting wrap 2 like a spiral from one side of mirror plate (or end plate) 1. Whirling blade 7 is similarly formed by projecting wrap 6 like a spiral from one opposite side of mirror plate (or end plate) 5 which has crankshaft bearing 4 on the other side thereof. Fixed and whirling blades 3 and 7 are combined with each other, as shown in FIG. 2, in such a way that their centers are shifted from each other and that their wraps 2 and 6 are so overlapped as to form spaces 11, each shaped like a crescent, between them.

Fixed and whirling blades 3 and 7 are housed in closed case 9 together with motor section 10 which serves as a drive source and which comprises rotor 11*a* and stator 12. Crankshaft 13 is coaxially connected to rotor 11*a* and freely rotatably supported in radial bearing 15 of frame 14 fixed in closed case 9. Crankshaft shaft 13 has at its front end portion eccentric pin 13*a* which is fitted into crankshaft bearing 4 of whirling blade 7. Fixed blade 3 is fixed at its circumferential wall 16, which is located outside the outer circumference of wrap 2, by bolts 17 to mount on the top of frame 14. Compressor section (or liquid mechanics section) 20 is thus formed, comprising an inlet located outside the circumferences of wraps 2 and 6 which face inlet chamber 18 enclosed by circumferential 16 of fixed blade 3 and frame 14, and an outlet located in the center portion of wraps 2 and 6 and communicated with outlet port 19 in the center of fixed blade 3.

When motor section 10 is made operative, whirling blade 7 is whirled round the center of fixed blade 3. As whirling blade 7 is whirled in this manner, volumes of crescent-shaped spaces 11 which are enclosed by wraps 2, 6 and mirror plates 1 and 5 are reduced more and more to compress gas therein.

In FIG. 1, reference numeral 21 represents an inlet pipe connected to the wall of closed case 9 below frame 14, 22 a passage formed in frame 14 to introduce gas into inlet chamber 18, 23 an outlet gas chamber (which serves as a muffler) formed on the rear side of mirror plate of fixed blade 3, and 24 an outlet pipe communicated with outlet gas chamber 23, passing through the top of closed case 9. The so-called closed compressor of the low pressure type intended to fill closed case 9 with inlet gas is thus formed.

In the case of the above-described scroll compressor, an Oldham's coupling is provided to prevent whirling blade 7 from rotating round its own axis. Oldham's ring 30 is used as the Oldham's coupling. In the case of Oldham's ring 30 shown in FIG. 3, a pair of key-like projections 25 are projected from one side of ring-shaped band plate 27, opposing to each other and aligning with each other on a line which passes through the axial center of plate 27, while another pair of key-like projections 26 are projected from the other side of ring-shaped band plate 27, opposing to each other and aligning with each other on a line which also passes through the axial center of plate 27 and which is perpendicular to the line on which projections 25 are aligned. This Oldham's ring 30 is located, as shown in FIG. 1, between whirling blade 7 and frame 14 which are opposed to each other. Upward projections 25 are freely slidably fitted into linear key grooves 28 formed on the rear side of mirror plate 5 of whirling bade 7 along a line which passes through the center of mirror plate 5, while downward projections 26 are freely slidably fitted into linear key grooves 29 formed on the top side of frame 14 along a line perpendicular to the above-mentioned line which passes through the center of mirror plate 5. In short, the direction in which blade 7 is whirled is limited to a certain range by two pairs of projections 25, 26 and key grooves 28, 29 to thereby prevent whirling blade 7 from rotating round its own axis.

In the case of this Oldham's ring 30, projections 25 and 26 must be projected on both sides of band plate 27 so as to position on those lines which are perpendicular to each other. When Oldham's ring 30 is to be made, therefore, one side or top side of band plate 27 is positioned and fixed relative to the process machine and projections 25 are formed on this side of band plate 27. The other side or underside of band plate 27 is then positioned relative to the process machine and projections 26 are formed thereon.

The accuracy of that right angle which is formed by the line extending between projections 25 and by the other line extending between projections 26 (which will be hereinafter referred to as the accuracy of the right angle between projections 25 and 26) is influenced b the process machine, the accuracy of positioning both sides of band plate 27 relative to the process machine and the accuracy of the jig.

In the case of conventional Oldham's ring 30, therefore, it is quite difficult from the viewpoint of processing to keep so well the accuracy of the right angle between projections 25 and 26, and this Oldham's ring 30 is not suitable for mass production. Particularly when the accuracy of the right angle between projections 25 and 26 is not so well, clearances between projections 25 and key grooves 28 and between projections 26 and key grooves 29 must be made large. When the fluid scroll machine is operated, therefore, projections 25 and 26 cannot slide at their faces relative to key grooves 28 and 29, leaving some of their faces untouched with key grooves 28 and 29. This increases sliding loss and damage will be added to projections 25 and 26 as time goes by. Further, whirling blade 7 cannot be prevented sufficiently from rotating round its own axis. Blade 7 is thus whirled while rotating round its own axis, thereby making it impossible for blade 7 to be held as it should be. In addition, clearance is caused between fixed and whirling blades 3 and 7 and when gas is being compressed, compressed gas leaks from crescent-shaped spaces 11 to thereby cause compression loss.

It is therefore supposed that projections are projected from the outer circumference of band plate 27 so as not to position the top and under sides of band plate 27 relative to the process machine, but when so arranged, the Oldham's coupling becomes large in size and so heavy.

Same thing can be said about the Oldham's coupling employed by the fluid scroll machine wherein both of the blades are rotated, that is, a main rotating blade and its follower blade (which include spiral wraps projected from the opposite sides of the mirror plates) are combined with each other to alternately overlap their wraps one upon the other.

SUMMARY OF THE INVENTION

The object of the present invention is to provide fluid scroll machine which is smaller in size, lighter in weight and capable of enhancing the accuracy of the right angle between the projections by employing an Oldham's coupling including a ring shaped plate having a first and second pair of projection on the same side of the ring shaped plate.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the detailed description of the preferred embodiments.

BRIEF DESCRIPTION OF THE DRAWINGS

The accompanying drawings, which are incorporated in and constitute a part of the specification, illustrates presently preferred embodiments of the invention and, together with the general description given above and the detailed description of the preferred embodiments given below, serve to explain the principles of the invention.

FIGS. 4 through 7 show an embodiment of the present invention in which FIG. 4 is a perspective view showing an Oldham's coupling, FIG. 5 is a sectional view showing a fluid scroll machine in which whirling and fixed blades are combined with each other using the Oldham's coupling shown in FIG. 4, as illustrated in a similar manner to FIG. 1, FIG. 6 is a side view showing the Oldham's coupling and its vicinity, and FIG. 7 is a plan view showing the connecting relation between the Oldham's coupling and the blades viewed from the side of the whirling blade;

FIGS. 10 through 17 show another embodiment of the present invention in which FIG. 10 is a vertically sectioned view showing a fluid scroll machine of the both blades rotation type, FIG. 11 is a side view showing the fluid mechanics from which the main rotating blade is excluded, FIG. 12 is a sectional view taken along a line 12—12 in FIG. 10, FIG. 13 is a front view showing the main rotating blade, and FIGS. 14 through 17 are views showing how compression is carried out by the synchro-rotation of main and follower blades;

FIGS. 19 through 21 show a variation of the Oldham's coupling in which FIG. 19 is a side view showing a combination of the Oldham's coupling and the blades, FIG. 20 is a rear view showing the Oldham's coupling, and FIG. 21 is a side view showing the Oldham's coupling;

FIGS. 24 through 26 show a further embodiment of the fluid scroll machine in which FIGS. 24 and 25 are plan and side views showing an Oldham's coupling, and FIG. 26 is a sectional view showing the whole of the machine.

DETAILED DESCRIPTION OF THE PREFERRED EMBODIMENTS

Figure 1:
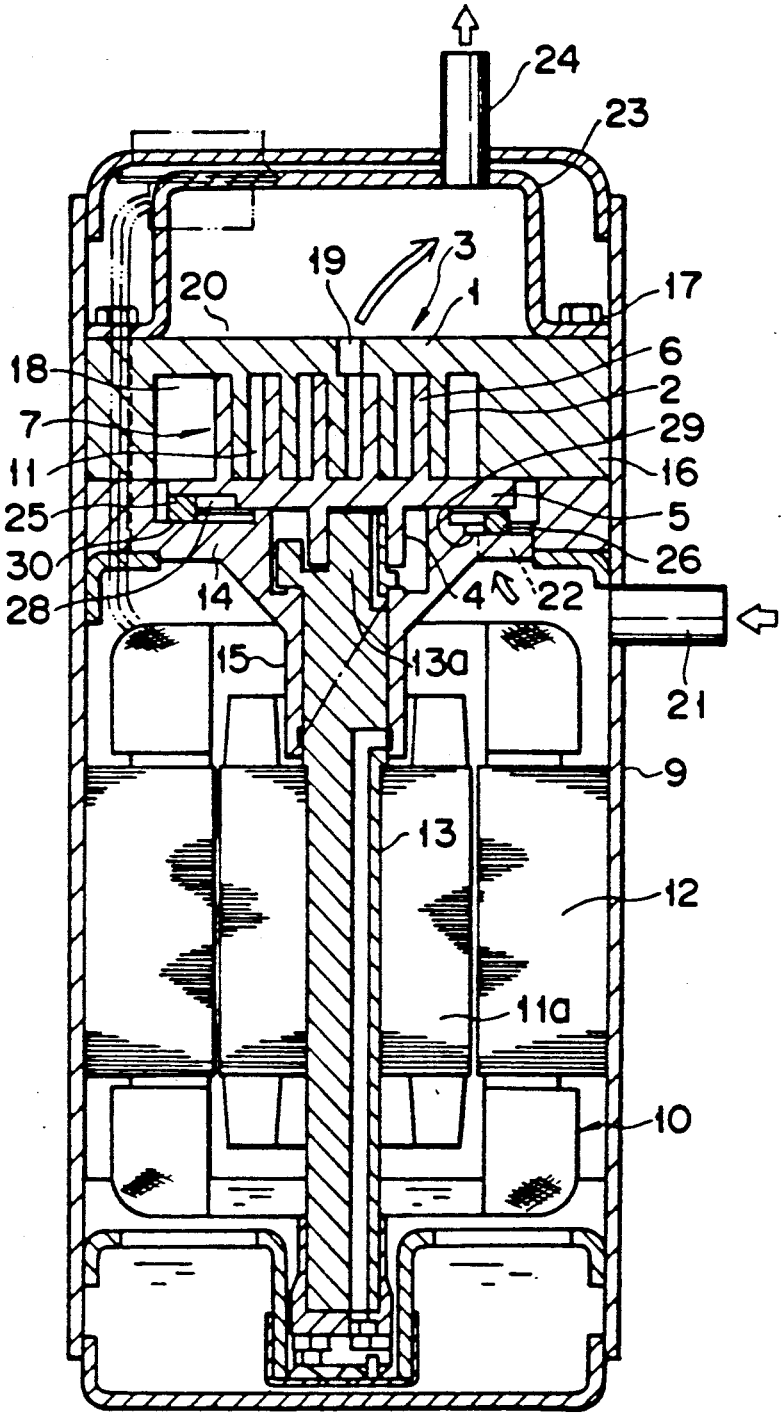
PRIOR ART FIG. 1
FIG. 1 is a vertically sectioned view showing one of the conventional scroll compressors, in which two sectional lines are perpendicularly crossed at the center axis.

An embodiment of the present invention will be described in detail with reference to FIGS. 4 through 7. Same components as those described in "Background of the Invention" will be represented by same reference numerals and description on these components will be omitted.

Figure 4:
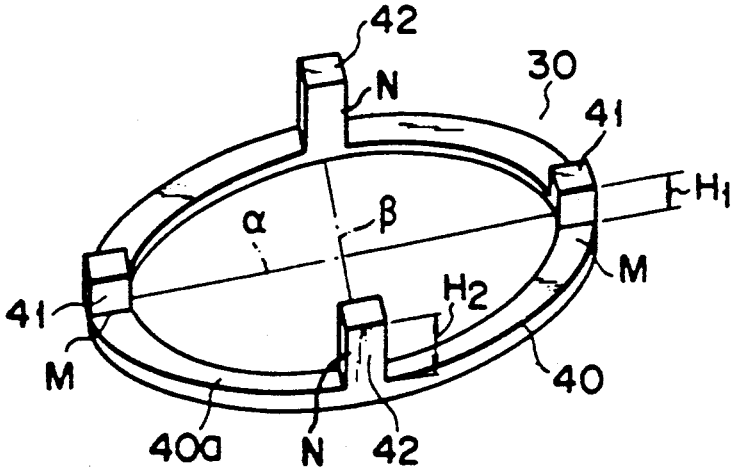

According to this embodiment, Oldham's ring 30 which serves as the Oldham's coupling comprises a pair of key-shaped projections 41 and another pair of key-shaped projections 42 on one side or top 40*a* of ring-shaped band plate 40 whose top and bottom sides are flat and parallel to each other. More specifically, paired projections 41 are positioned at M and M on a line $\alpha$ extending in the first radial direction to pass through the axial center of band plate 40 while another paired projections 42 at N and N on a line $\beta$ extending in the second radial direction to pass through the axial center of band plate 40 and perpendicular to line $\alpha$, as shown in FIG. 4. It is preferable to shape each of these projections like a cube or rectangular body. As seen in the case of the conventional Oldham's rings, height $H_1$ of first paired projections is set in such a manner that their upper portions can fit into key grooves 46 (which will be described later) in mirror plate 5 which is located opposite to the Oldham's ring. Height $H_2$ of second paired projections 42 is larger than that of first paired projections 41, as shown in FIG. 4. More concretely, their height $H_2$ is set larger than the thickness (h) of mirror plate 5, for example.

Figure 5:
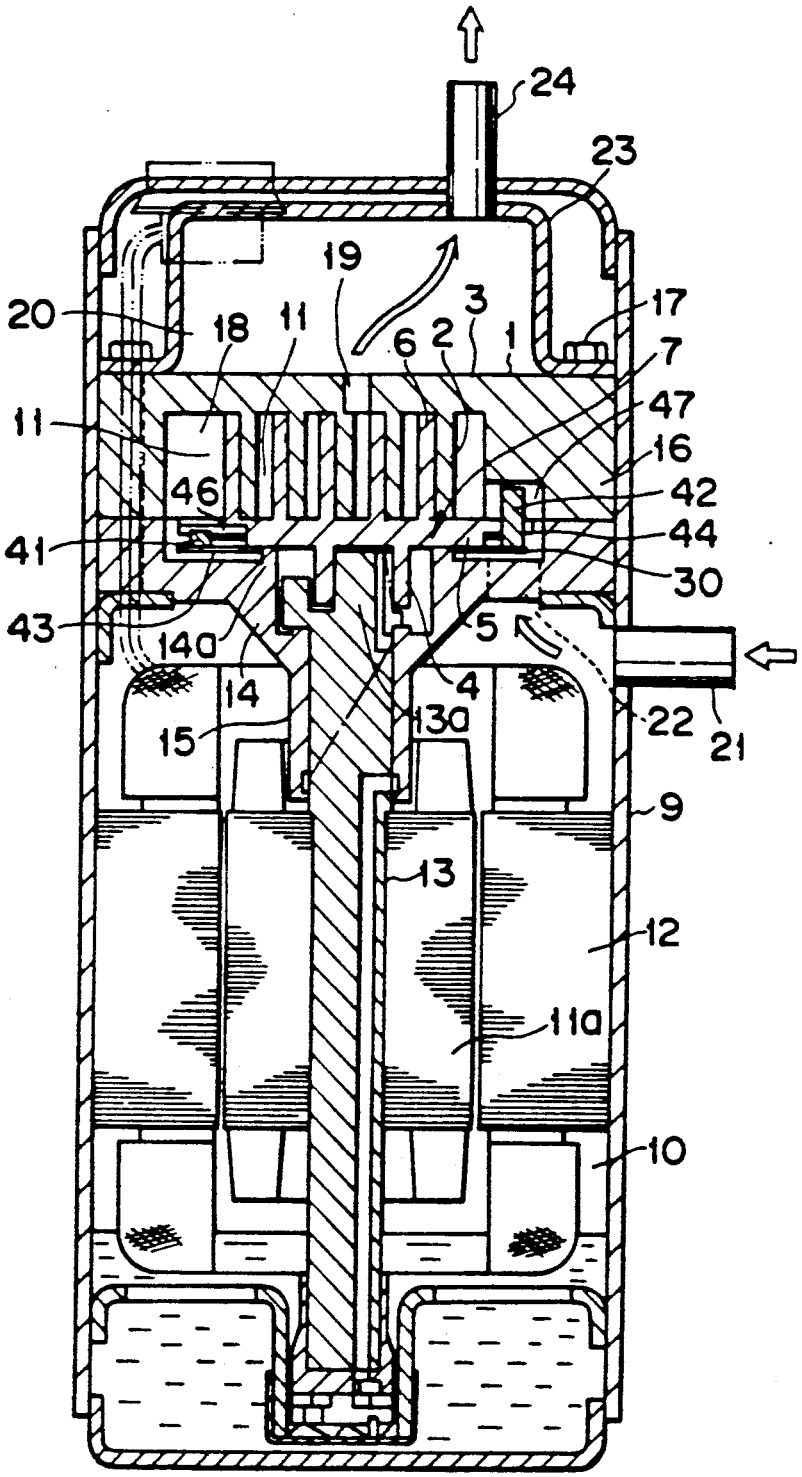
Figure 6:
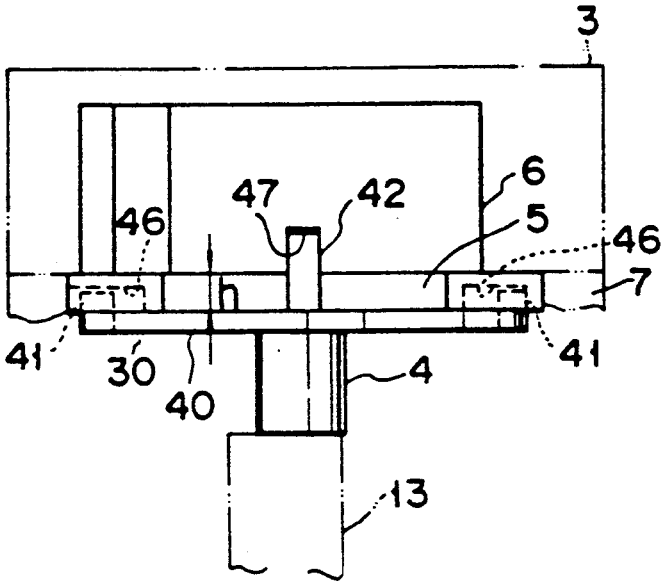

This Oldham's ring 30 is located between mirror plate 5 of whirling blade 7 and the top of frame 14, directing its side or top, from which the projections are projected, to whirling blade 7, as shown in FIG. 5. Ring-shaped plate 43 is projected outward from the outer circumference of ring-shaped sliding portion 14*a* and on same plane as this sliding portion 14*a*, which is projected from the top of frame 14 adjacent to crankshaft bearing 4 and eccentric pin 13*a* to support mirror plate 5 of whirling blade 7. Further, ring-shaped groove 44 is formed on the rear side of mirror plate 5 and along the outer rim thereof which is opposed to ring-shaped plate 43, and band plate 40 is housed in a ring-shaped space enclosed by ring-shaped plate 43 and groove 44. The Oldham's ring is thus supported by fixed frame 14 to move on the horizontal plane.

Figure 7:
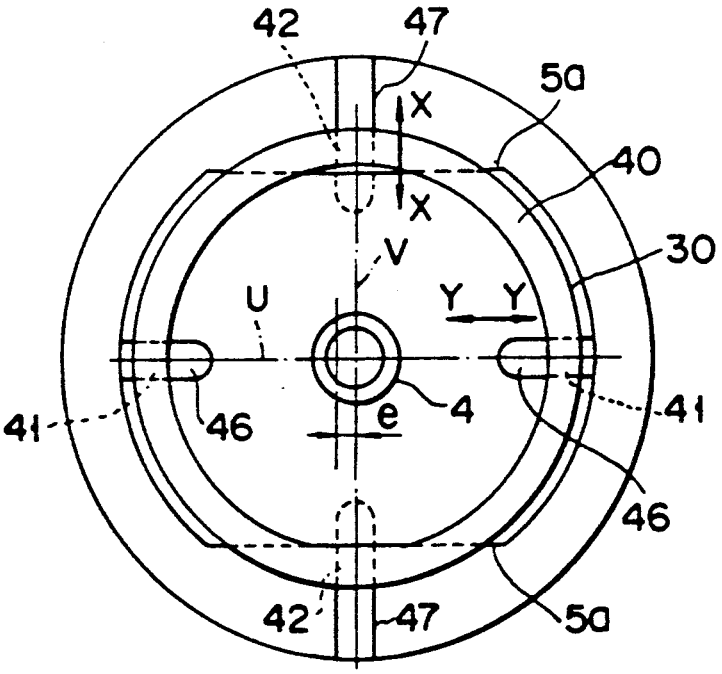

A pair of key grooves 46 (which correspond to first guide passages) are formed on those portions of mirror plate 5 which are opposed to first projections 41, extending along line U which passes through the axial center of whirling blade 7 and which is directed in the same direction as line $\alpha$, as viewed from the side of the Oldham's ring in FIG. 7. Those portions of mirror plate 5 which correspond to second projections 42 are cut off from mirror plate 5 along a straight line. Second projections 42 of Oldham's ring 30 are therefore projected higher than mirror plate 5 without being hindered by mirror plate 5, while first projections 41 thereof are fitted into key grooves 46 to freely slide along line U.

A pair of key grooves 47 (which correspond to second guide passages) are formed on those portions of circumferential wall 16 of fixed blade 3 which are opposed to second projections 42, extending along line V which passes through the axial center of whirling blade 7 and which is directed in the same direction as line $\beta$ and perpendicular to line U. Each of these key grooves 46 and 47 has substantially same width as each of projections 41 and 42 has, and its both sides extend parallel to each other to define this width. The tops of second projections 42 projected higher than mirror plate 5 are fitted into second key grooves 47 to freely slide along line V and the sliding of projections 41 and 2 relative to key grooves 46 and 47 allows whirling blade 7 to move in the right-angled two directions, while limiting the movement of whirling blade 7 in its rotating direction.

Symbol (e) in FIG. 7 represents the distance of the axial center of crankshaft 13 shifted from the center of crankshaft seat 4 of whirling blade 7 (or center of whirling blade 7).

The Oldham's coupling allows second projections 42 to linearly slide in key grooves 47 of fixed blade 3. The whirling blade is therefore allowed relative to the fixed side only to move in direction X—X, as shown in FIG. 7. The Oldham's coupling also allows first projections 42 to linearly slide in key grooves 46 of the whirling blade The whirling blade is therefore allowed relative to the fixed side only to move in direction Y—Y, as shown in FIG. 7. This enables whirling blade 7 to move relative to the fixed side in directions X—X and Y—Y, while being prevented from rotating round its own axis.

When crankshaft 13 is driven at motor section 10, blade 7 is whirled, using distance (e) as its radius but being prevented from rotating round its own axis by Oldham's ring 30 which is provided with projections 41 and 42 on its same side.

As apparent from the above, it is not needed that top and bottom sides of Oldham's ring 30 are positioned relative to the process machine when they are to be processed.

Oldham's ring 30 is not influenced by the accuracy of positioning its top and bottom sides relative to the process machine and by the accuracy of the jig. This enables the accuracy of the right angle between projections 41 and 42 to be enhanced, thereby solving the problems of sliding loss, damage of Oldham's ring 30 and compression loss. In addition, the arrangement of forming first and second projections on the same side of Oldham's ring 30 enables Oldham's ring 30 to be made small in size and light in weight. Therefore, vibration caused by Oldham's ring 30 reciprocating in key grooves 46 and 47 can also be reduced.

Figure 8:
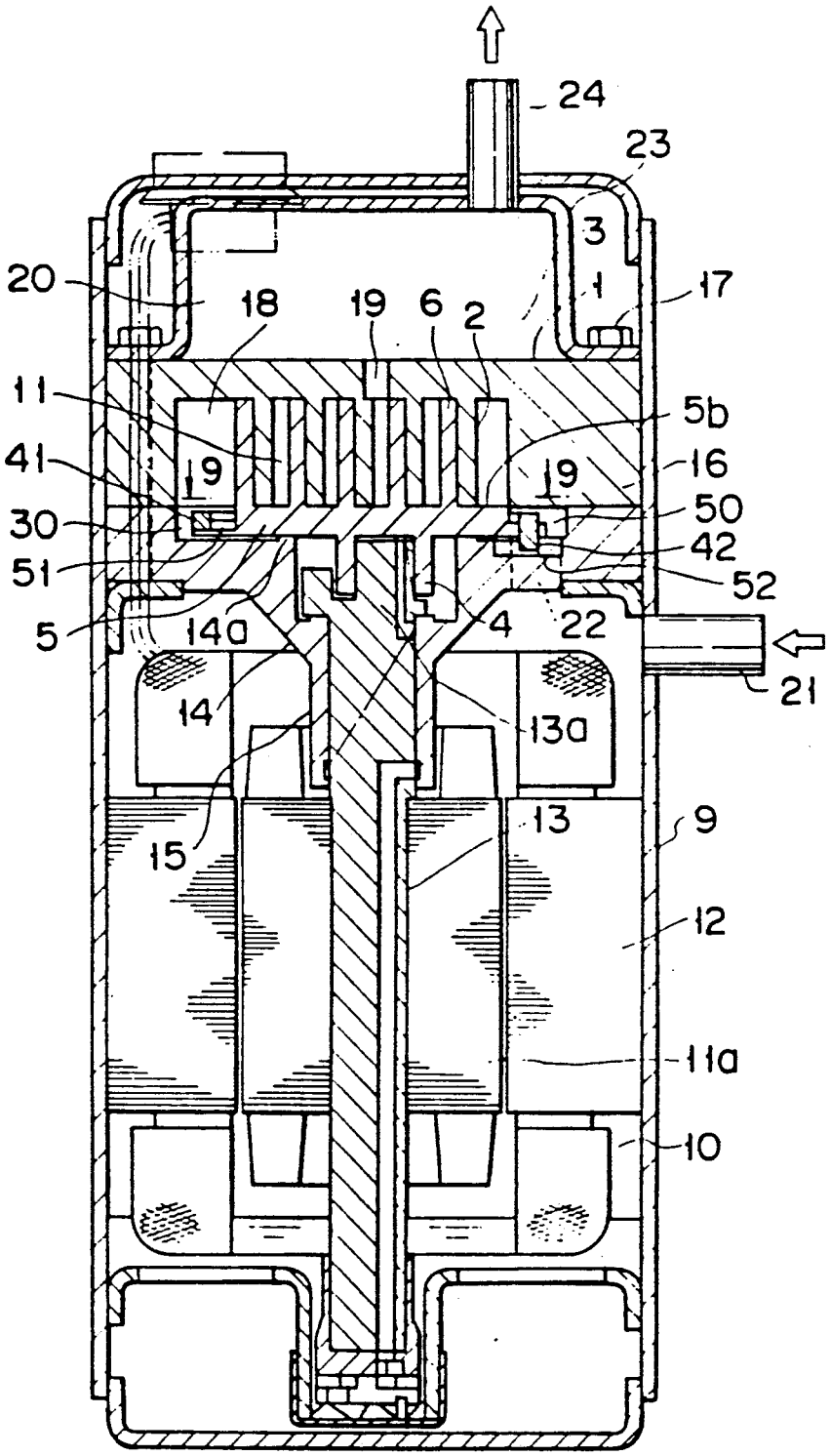
FIG. 8 is a vertically sectioned view showing another fluid scroll machine.
Figure 9:
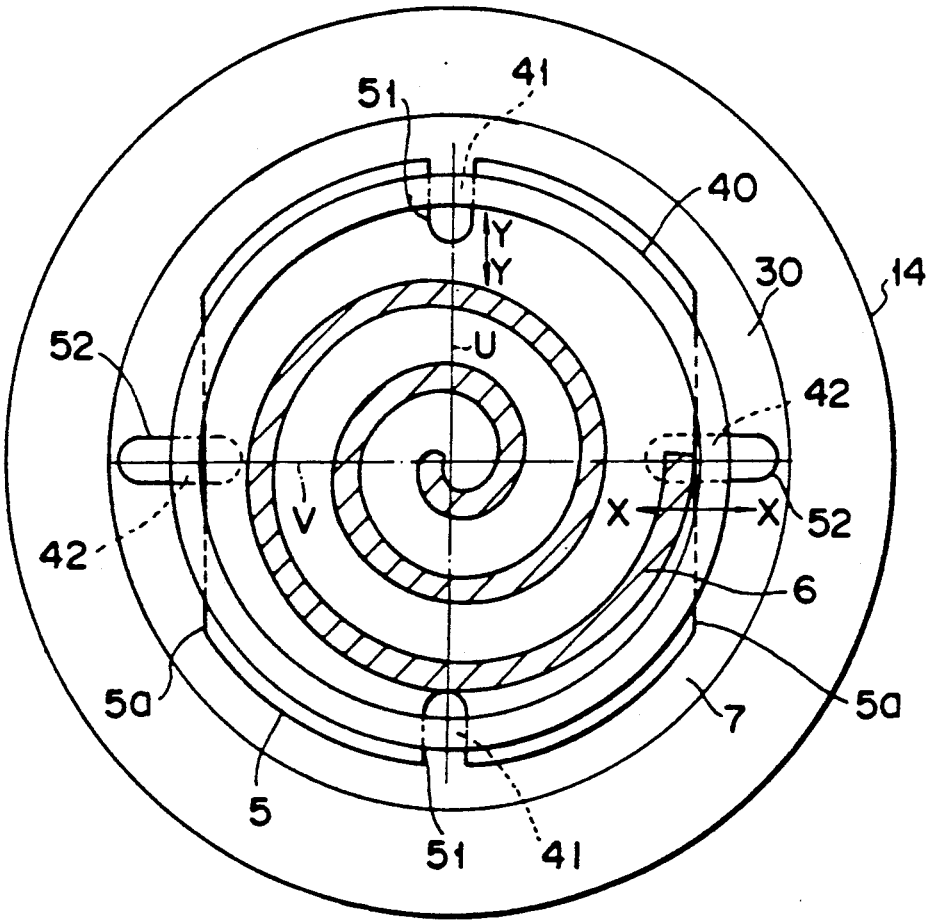
FIG. 9 is a cross sectional view taken along a line 9—9 in FIG. 8.
Figure 10:
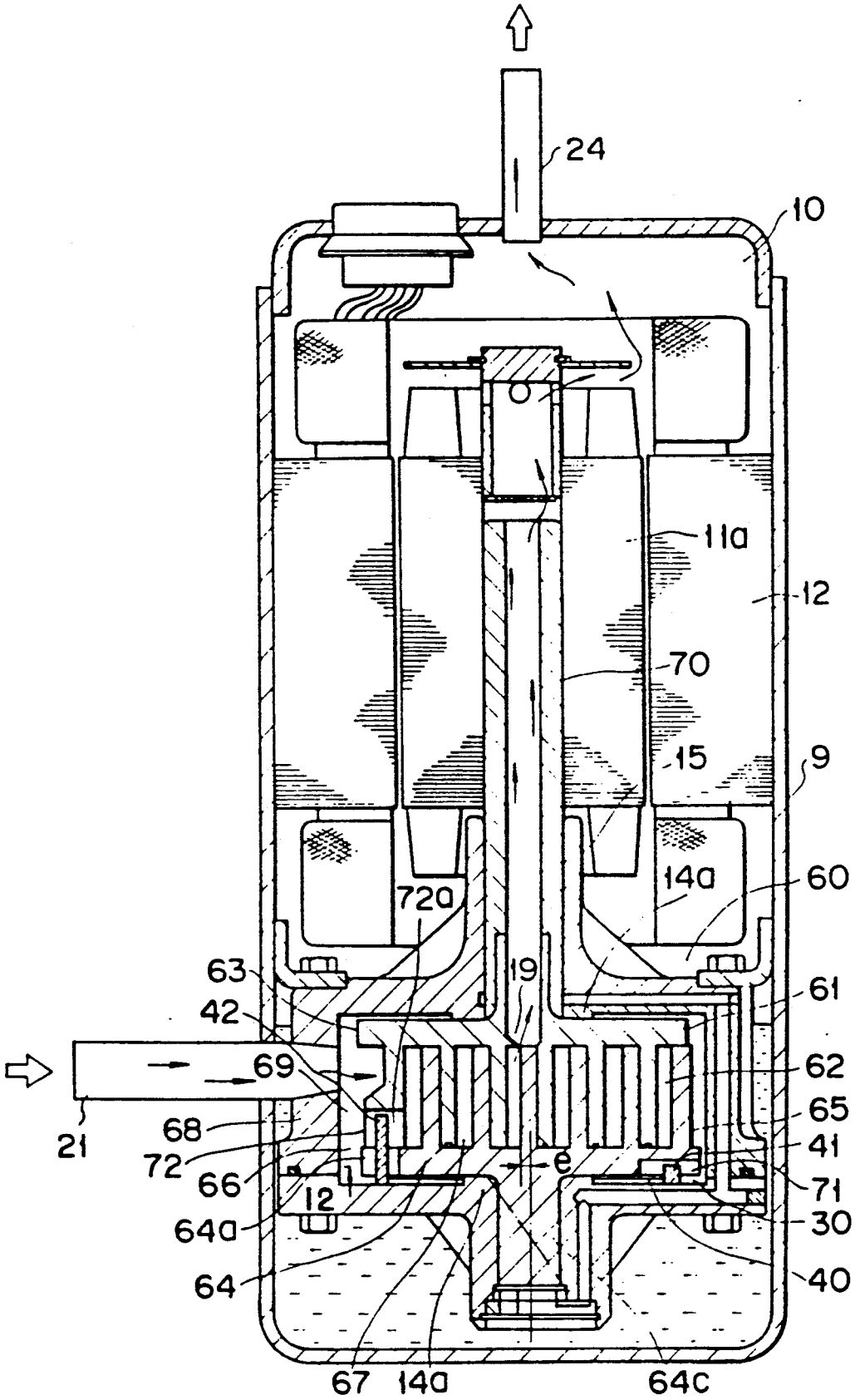
Figure 11:
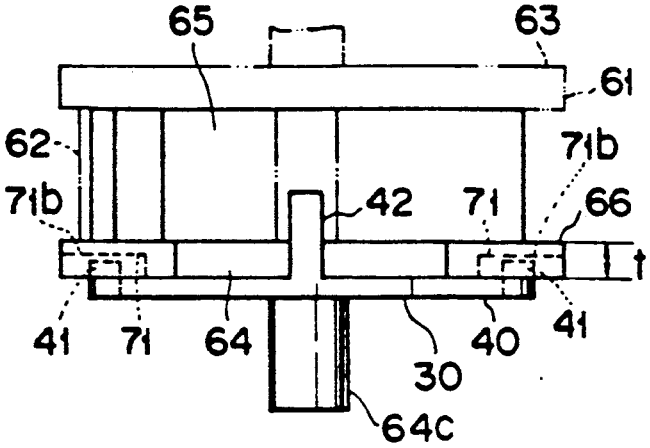

Although Oldham's ring 30 has been located on the rear side of mirror plate 5 of whirling blade 7 in the case of the above-described embodiment, it may be located on that side of mirror plate 5 from which wrap 6 is projected, as shown in FIGS. 8 and 9.

In an embodiment shown in FIGS. 8 and 9, recess 50 is formed on that side **5*b* of mirror plate 5, from which wrap 6 is projected, along the outer rim thereof and Oldham's ring 30 is located in recess 50, directing its first and second projections 41 and 42 downward. First projections 41 of Oldham's ring 30 are freely slidably fitted into key grooves 51 formed in those portions of side 5*b* which crosses line U. Top portions of second projections 12 of Oldham's ring 30 which are projected lower than mirror plate 5 of whirling blade 7 are freely slidably fitted into key grooves 52 formed in the top of sliding portion 14*a* of frame 14** and along line V perpendicular to line U.

The fluid scroll machine to which the present invention is applied may be of the lower pressure case type in which closed case 9 is filled with inlet gas or of the high pressure case type in which closed case 9 is filled with outlet gas.

Another embodiment of the present invention will be described referring to FIGS. 10 through 17.

The present invention is applied, in this case, not to the compressor section which comprises a combination of paired fixed and whirling blades but to compressor section 60 in which both of rotating blades are rotated.

To describe compressor section 60, main rotating blade 63 which comprises projecting spiral wrap (or blade) 62 from one side of mirror plate (or end plate) 61 and follower rotating blade 66 which comprises mirror plate (or end plate) 64 and wrap (or blade) 65 are combined with each other in such a way that their rotating centers D and E are shifted from each other and that their wraps 62 and 65 are alternately overlapped one upon the other to form crescent-shaped spaces 67 between them. It is intended that the rotation of main rotating blade 63 driven by the motor section 10 is transmitted to follower rotating blade 66 through Oldham's ring 30, and when wraps 62 and 65 are rotated round their own centers D and E, respectively, volumes of spaces 67 between them become smaller as they come from outer circumferences of their mirror plates to centers thereof. Main and follower rotating blades 63 and 66 are housed in outlet chamber 69 formed by frame 68 and the outside of outer circumferences of the wraps which faces inlet chamber 69 serves as inlet side, while center portions of wraps 62 and 65 which are opened at outlet port 19 serve as outlet side.

Reference numeral **64*c* represents a shaft projected downward from the rear center of mirror plate 64 for follower blade 66 and freely rotatably supported by the bearing of frame 68. The axis center of shaft 64*c* and rotating center E of main rotating blade 63 are shifted by distance (e) from the axis center of shaft 70 connected to motor section 10**.

Figure 13:
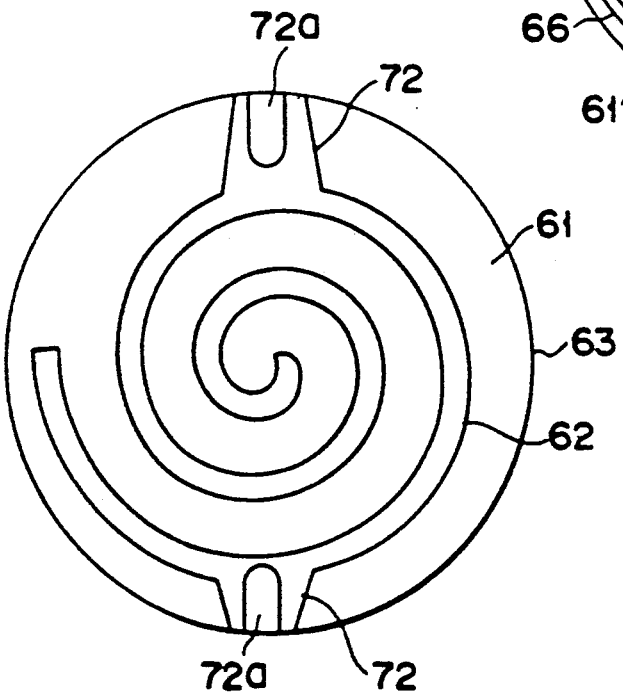
Figure 14:
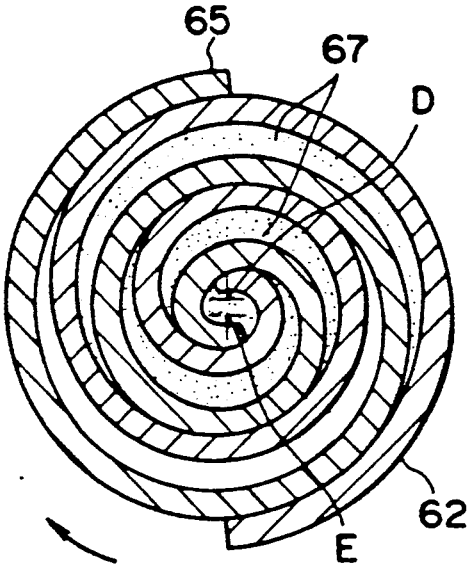
Figure 15:
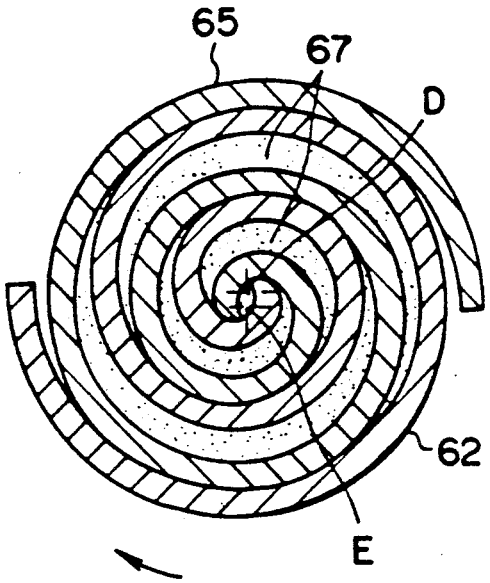
Figure 16:
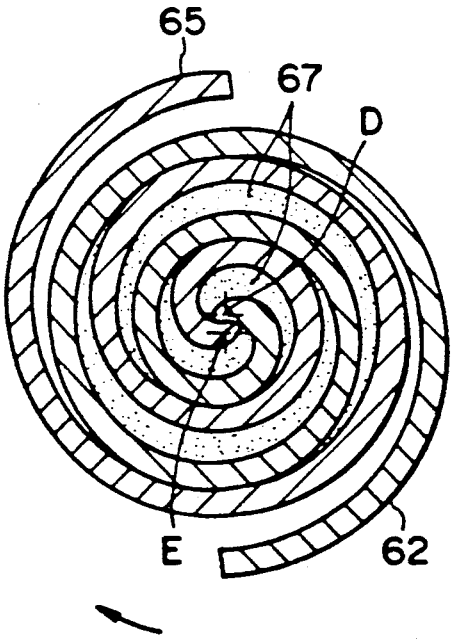
Figure 17:
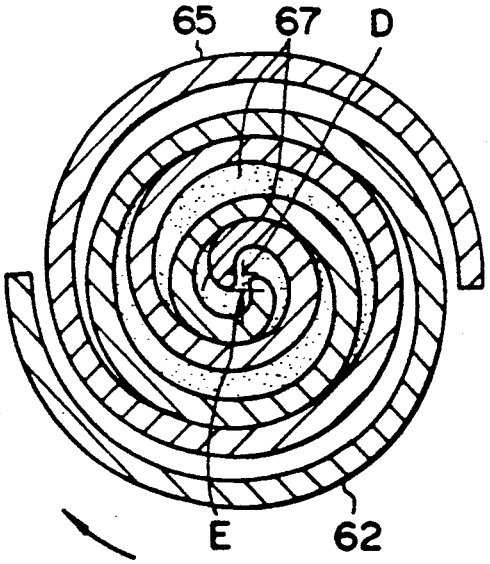

Oldham's ring 30 which forms the Oldham's coupling device is similar in structure in this case to the one which has been described above. In the case of this Oldham's ring 30, height $H_1$ of each of its first projections 41 is set to meet mirror plate 64 for follower rotating blade 66 and height $H_2$ of each of its second projections 42 is set larger than thickness (t) of mirror plate 64 for follower rotating blade 66. Oldham's ring 30 is located between the underside of follower rotating blade 66 and the opposed wall face of inlet chamber 69, directing its projections 41 and 42 toward follower rotating blade 66. First projections 41 of Oldham's ring 30 are freely slidably fitted into a pair of key grooves 71 formed in a face of mirror plate 64 and along line U which passes through the center of mirror plate 64 and extends in direction $\alpha$. Second projections 42 of Oldham's ring 30 are projected higher than mirror plate 64 for follower rotating blade 66, because mirror plate 64 is provided at its outer area with a pair of cut-away portions 64*a* which are opposed to each other with an interval of 180° interposed between them and which allow second projections to be projected higher than mirror plate 64 through them. Top portions of second projections 42 of Oldham's ring 30 thus projected are also freely slidably fitted into key grooves 72*a* formed at paired key groove members 72 which are projected outward from the outer circumference of wrap 62 of main rotating blade 63, and along a line perpendicular to line U, as shown in FIG. 13.

Figure 12:
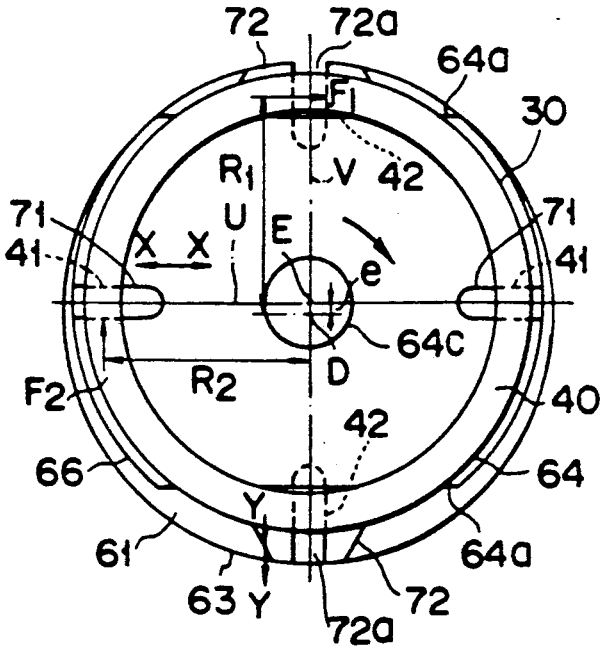

According to this Oldham's coupling device, Oldham's ring 30 can move relative to follower rotating blade 66 only in direction X—X shown in FIG. 12. Main rotating blade 63 can move relative to Oldham's ring 30 only in direction Y—Y shown in FIG. 12. This enables main rotating blade 63 not to rotate round its own axis relative to follower rotating blade 66 but to move in directions X—X and Y—Y.

Projections 41 and 42 can transmit the rotation of main rotating blade 63 to follower rotating blade 66, sliding distance (e) in key grooves 71 and 72*a* which are perpendicular to each other. More specifically, the rotating force of main rotating blade 63 is transmitted, as force $F_1$, to Oldham's ring 30 through second projections 42 and further, as force F2, to follower rotating blade 66 through first projections 41, providing that the distance from center D to projection 42 is represented by $R_1$ and that the distance from center D to projection 41 by $R_2$. In short, rotation torque is transmitted to intended components, changing force $R_1 \times F_1$ to $R_2 \times F_2$.

When both of the blades are rotated, therefore, Oldham's ring 30 having high accuracy of the right angle between projections 41 and 42 and also having projections 41 and 42 projected from its one side and being thus made small in size and light in weight enables the rotation of main rotating blade to be transmitted to the follower rotating blade. In addition, the transmission of rotating force through this Oldham's ring 30 enables $R_1 \times F_1 = R_2 \times F_2$ to be established. Therefore, forces $F_1$ and $F_2$ can be changed to make Oldham's ring 30 strong. When band plate 40 is transformed to establish $R_1 \neq R_2$, for example, force $F_1$ or $F_2$ can be made small. When it is arranged that key grooves 71 are formed on mirror plate 64 and closed by wall 71*b* on the side of wrap 65 to receive projections 41, Oldham's ring 30 can be attached to the underside of mirror plate 64 at any positions thereof and this enables Oldham's ring 30 to be freely designed. When it is so arranged, Oldham's ring 30 provides no resistance against fluid taken into spaces 67 or discharged from them.

Figure 18:
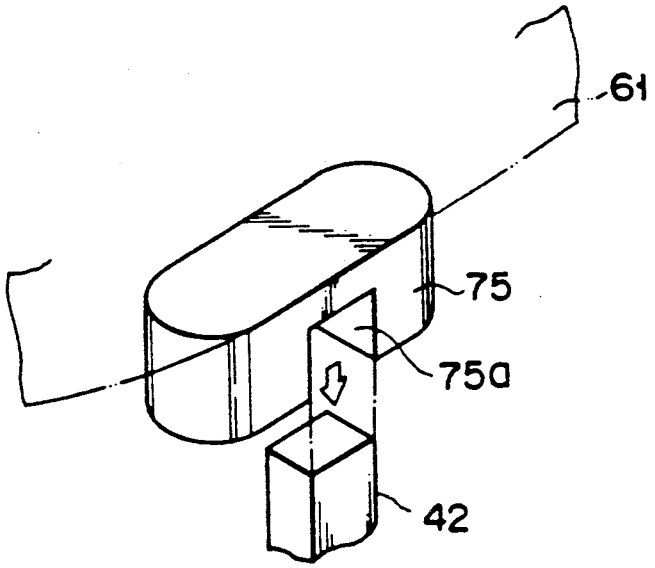
FIG. 18 is a perspective view showing a rotating blade provided with a differently shaped key groove and its key.

The structure of key grooves for projections 42 of Oldham's ring 3 may be as shown in FIG. 18 instead of projecting key grooves members from the outer circumference of wrap 62. Namely, column members 75 each same in height as or lower than wrap 62 and having key groove 75*a* on its top may be provided on that face of mirror plate 61 for main rotating blade 63 from which wrap 62 is projected.

Figure 19:
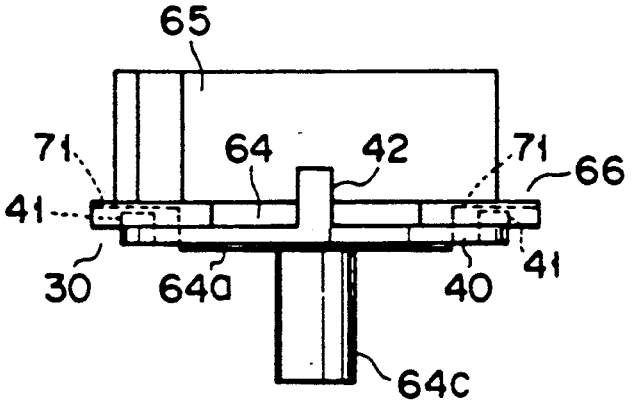

Oldham's ring 30 may be arranged not to project from the underside 64*b* of mirror plate 64, as shown in FIG. 19. When it is arranged in this manner, compressor section 20 can be small-sized.

Figure 20:
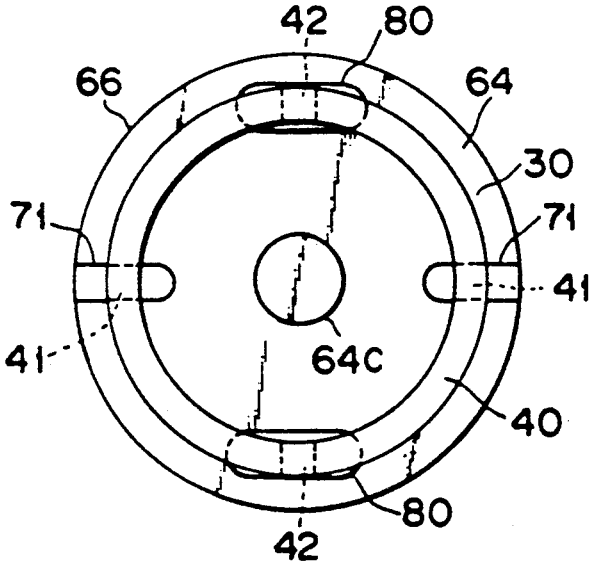

Instead of providing mirror plate 64 with cut-away portions 64*a* to allow projections 42 to project higher than mirror plate 64, elongated through-holes 80 each having such a size that allows projection 42 to move therein a predetermined distance without contacting mirror plate 64 may be formed in mirror plate 64, as shown in FIG. 20.

Figure 21:
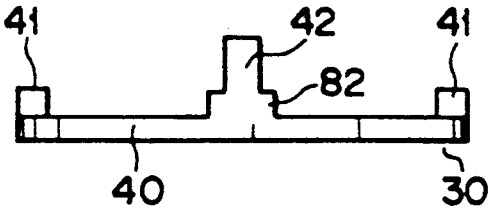

That base portion of each of projections 42 which is exposed between key groove 72 and mirror plate 64 may be made larger, as shown in FIG. 21. When projection 42 is made to have large portion 82 at its base, it can be so reinforced as to transmit so large force.

Although Oldham's ring 30 has been located on the underside of follower rotating blade, it may be located on the underside of main rotating blade 66 and same merit as described above can be obtained also in this case.

Figure 22:
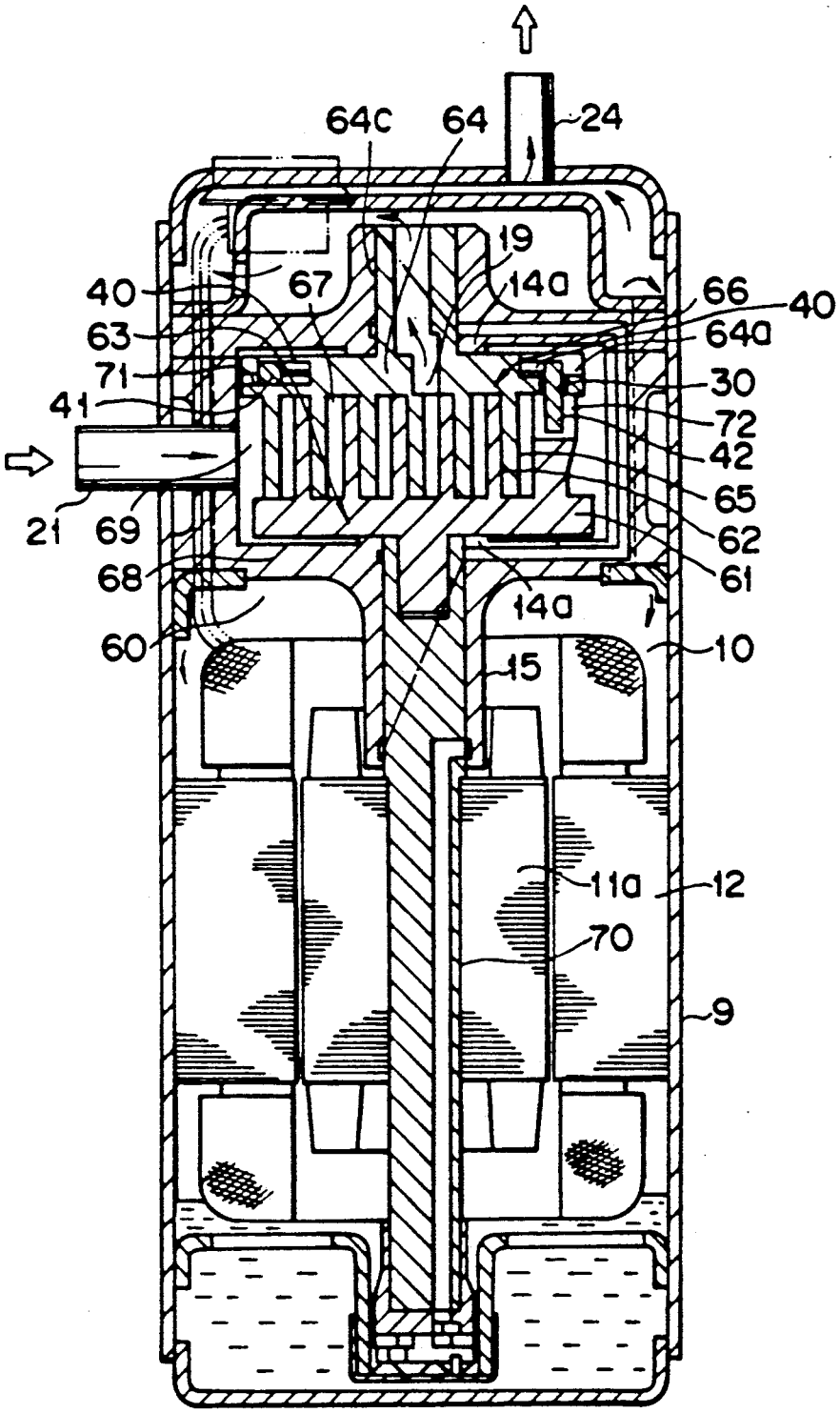
FIG. 22 is a sectional side view showing further embodiment of the fluid scroll machine of the both blades rotation type in which the fluid mechanics are located at the upper portion of the machine, using the Oldham's coupling.
Figure 23:
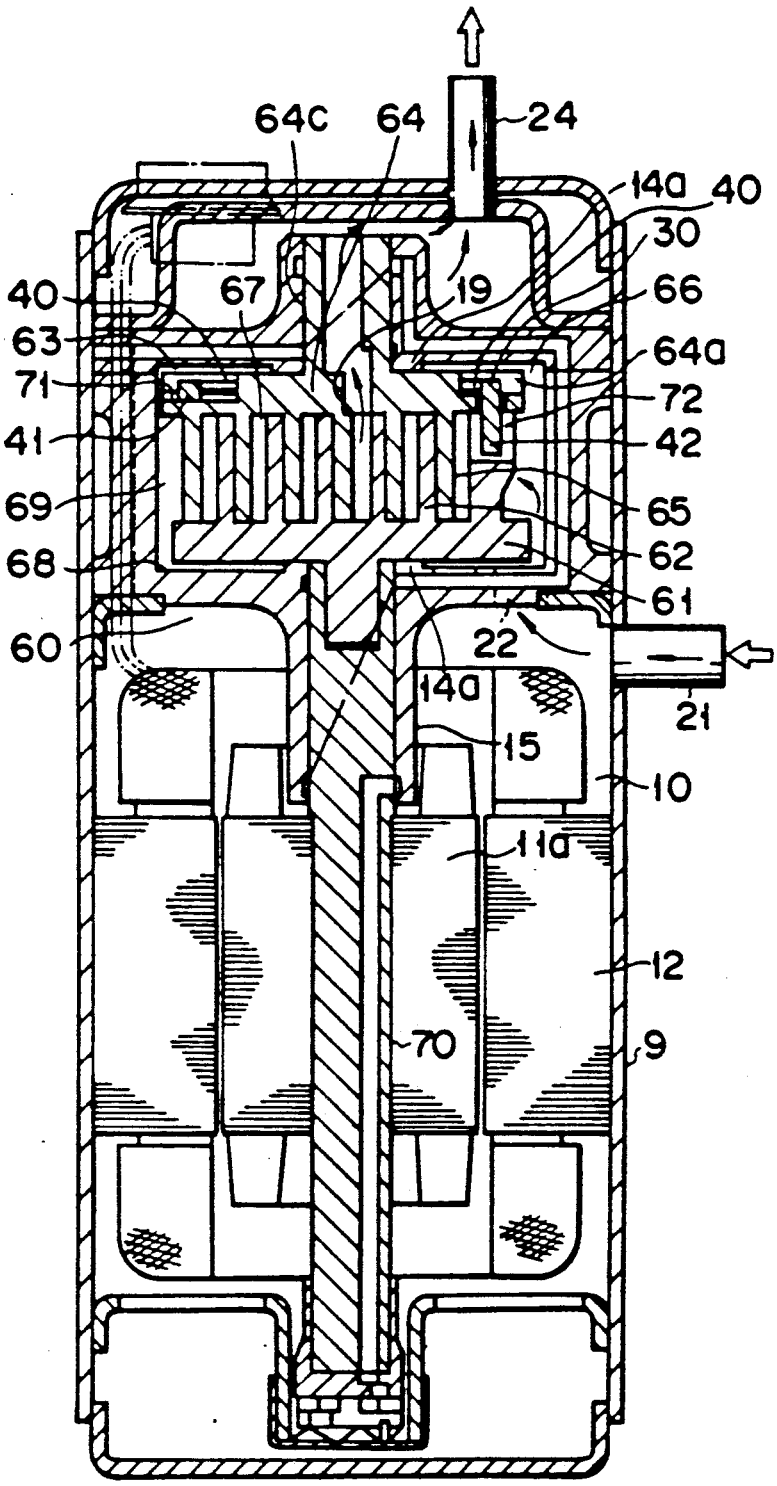
FIG. 23 is a sectional side view showing a fluid scroll machine of the low presser type similar to the one shown in FIG. 22.

Although the compressor mentioned above have been of the closed type provided with motor section 10 at the upper portion of closed case 9 and compressor section 20 at the lower portion thereof, the present invention may be applied to those compressors of the closed type in which compressor section 20 is located at the upper portion of closed case 9, motor section 10 at the lower portion thereof and closed case 9 is filled with outlet gas, as shown in FIG. 22. Instead of this compressor of the high pressure case type in which closed case 9 is filled with outlet gas, the present invention may also be applied to the one of the low pressure case type in which closed case 9 is filled with inlet gas, as shown in FIG. 23.

Figure 2:
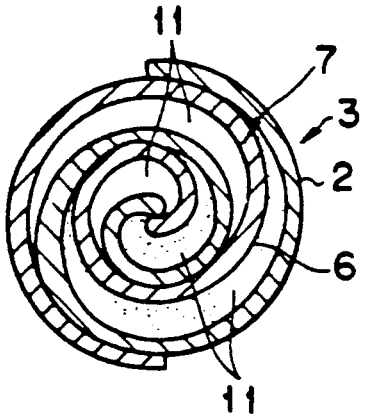
PRIOR ART FIG. 2
FIG. 2 is a cross sectional view showing blades combined.
Figure 3:
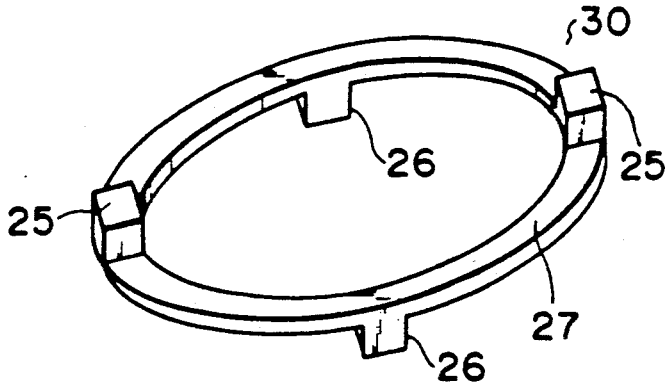
PRIOR ART FIG. 3
FIG. 3 is a perspective view showing an Oldham's coupling used for the blades.

Same components as those shown in FIG. 2 have been represented by same reference numerals and nothing has been said about these components in the above description made referring to FIGS. 8 through 23.

Although the present invention has been applied to the compressors, it may be applied to other fluid machines such as expansion machines, pumps and blowers.

According to the present invention as described above, a fluid scroll machine having an excellent accuracy of the right angle between projections can be provided. Sliding loss, damage of the Oldham's coupling and compression loss all of which are caused because the accuracy of the right angle between projections is not so well can be thus reduced. In addition, the Oldham's coupling can be made smaller in size and lighter in weight. Further, vibration caused by the Oldham's coupling reciprocating in the guide passages can also be reduced.

Figure 25:
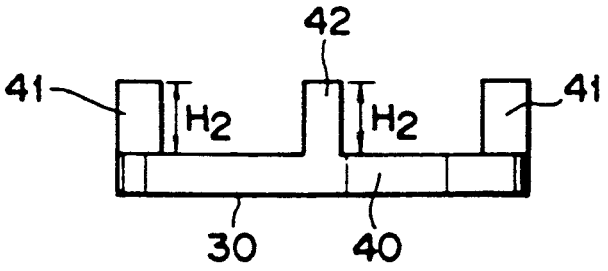
Figure 26:
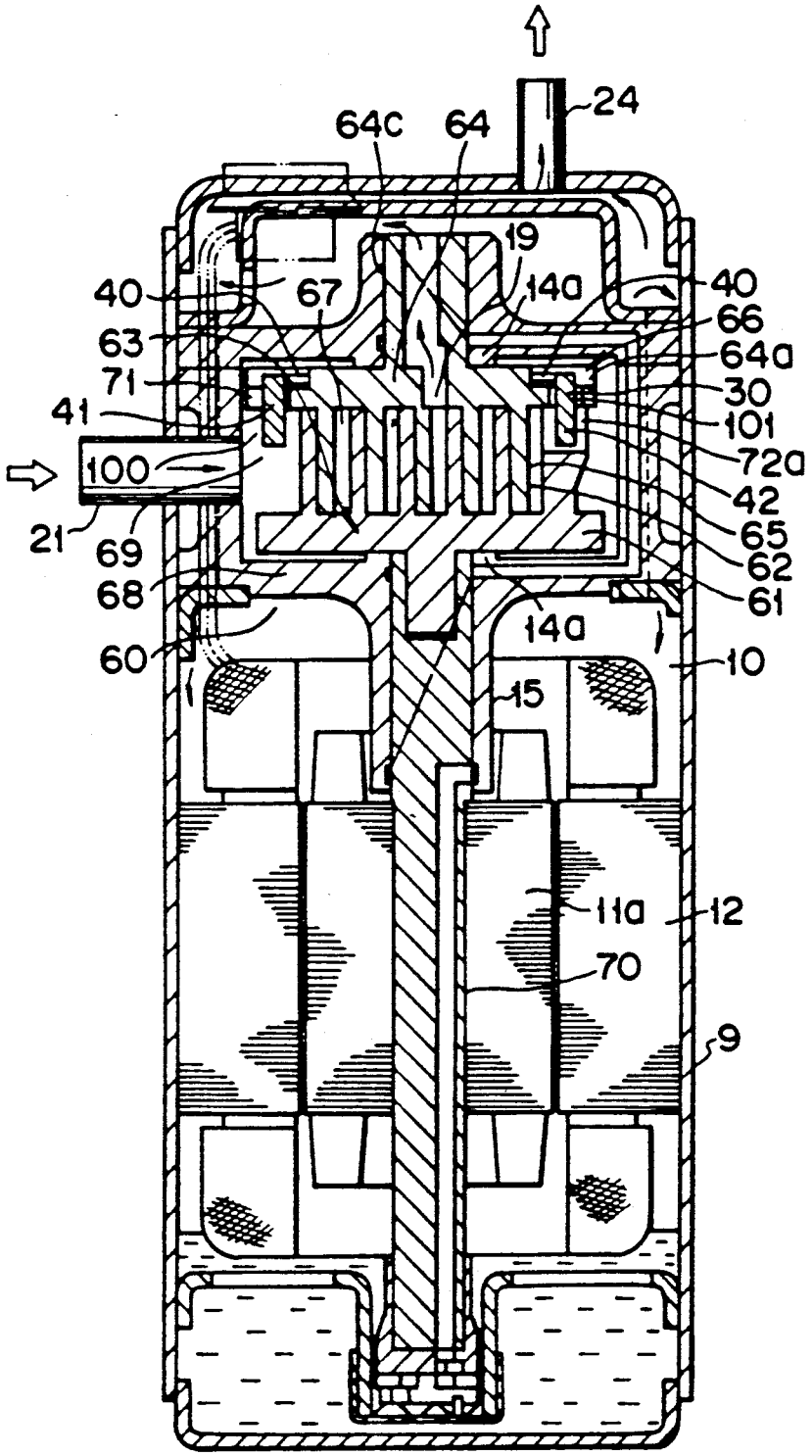

A further embodiment of the present invention will be described referring to FIGS. 24 through 26.

Figure 24:
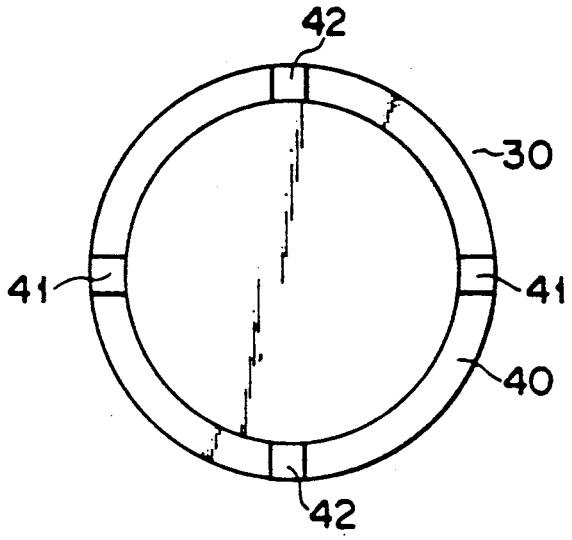

Oldham's ring 30 has first and second projections 41 and 42 projected from one side of ring-shaped plate 40 and at same positions as in the above-described embodiments, as shown in FIG. 24. First projections 41 are same in height as second projections 42, as shown in FIG. 25. Their height $H_2$ is set larger than the thickness of the mirror plate for follower rotating blade 66 which will be described later. The fluid scroll machine provided with this Oldham's ring 30 is of the type in which the first and second blades serve as main and follower rotating blades 63 and 66, as shown in FIG. 22. First projections 41 are slidably fitted into key grooves 71 formed on mirror plate 64 for follower rotating blade 66 while second projections 42 into key grooves 72*a* formed on the end face of main are opened on the side of wrap 65 so that tops of first projections 41 can be projected from that face of mirror plate 64 from which wrap 65 is projected. In order to prevent these tops of projections 41 projected from mirror plate 64 from striking against main rotating blade 63 to hinder the rotation of blade 63, escape spaces 100 are formed along the outer rim of main rotating blade 63 and the tops of projections 41 are located in these escape spaces 100 to freely move therein. Escape holes 101 are formed in mirror plate 64 for follower rotating blade 66 to allow the tops of second projections 42 to project into key grooves 72*a*. Second projections 42 are inserted into key grooves 72*a*, passing through these escape holes 101. Each of escape holes 101 has a predetermined dimension so as not to cause mirror plate 64 and second projections 42 to slide relative to each other to hinder their movements.

According to this fluid scroll machine provided with the Oldham's ring which has first and second projections same in height, all of the projections projected from one side of the Oldham's ring can be processed under same conditions. Therefore, the accuracy of the right angle between projections can be enhanced and the cost of processing these projections can be reduced.

Additional advantages and modifications will readily occur to those skilled in the art. Therefore, the invention in its broader aspects is not limited to the specific details, and representative devices shown and described. Accordingly, various modifications may be made without departing from the spirit or scope of the general inventive concept as defined by the appended claims and their equivalents.

What is claimed is:

1. A fluid scroll machine comprising:

a fixed frame;

a fluid mechanism including fist and second blades, which have end plates opposed to each other at a certain interval and spiral wraps projecting from the end plates to alternately overlap one upon the other;

an Oldham's coupling movably supported by the fixed frame and including:

a ring-shaped plate having a first side facing the end plate of the first blade and an axis center, a pair of first projections projected from the first side of the ring-shaped plate and positioned on a line which extends in a firs radial direction to pass through the axis center of the ring-shaped plate, and a pair of second projections projected from the first side of the ring-shaped plate and positioned on another line which extends in a second radial direction perpendicular to the fist radial direction;

a pair of firs guide passages included in said first blade extending in the first radial direction of the ring-shaped plate for allowing the first projections to slide in the fist radial direction;

a pair of second guide passages included in said second blade extending in eh second radial direction of the ring-shaped plate for allowing the second projections to slide in the second radial direction; and a means for eccentrically rotation the first blade round the axis center of the ring-shaped plate.

2. The fluid scroll machine according to claim 1, wherein said second guide passages are further separated from the ring-shaped plate tan said fist guide passages, and said second projections are longer than said first projections.

3. The fluid scroll machine according to claim 2, wherein said second blade is fixed to the fixed frame and said second guide passages are formed in said end plane of said second blade.

4. The fluid scroll machine according to claim 2, wherein said second blade is rotatably supported by the fixed frame and said second guide passages are formed in the end plate of said second blade.

5. The fluid scroll machine according to claim 1, wherein said second guide passages are further separated from the ring-shaped plate than said fist guide passages, and said first and second projections have equal height.

6. A fluid scroll machine comprising:

a fixed frame;

a fluid mechanism including first and second blades, which have end plates opposed to each other at a certain interval and spiral wraps projecting from the end plates to alternately overlap one upon the other;

an Oldham's coupling located on the side of the said first blade from which the wrap is projected and including:

a ring-shaped plate having a first side facing the end plate of the first blade and an axis center, a pair of first projections projected from the first side of the ring-shaped plate and positioned on a line which extends in a first radial direction to pass through the axis center of ring-shaped plate, and a pair of second projections projected from the first side of the ring-shaped plate and positioned on another line which extends in a second radial direction perpendicular to the first radial direction;

a pair of first guide passages included in said first blade extending in the first radial direction of the ring-shaped plate for allowing the first projections to slide in the first radial direction;

a pair of second guide passages included in said fixed frame extending in the second radial direction of the ring-shaped plate for allowing the second projections to slide int eh second radial direction; and a means for eccentrically rotating the first blade round the axis center of the ring-shaped plate.

* * * * *